US010058171B2

(12) United States Patent
Deng

(10) Patent No.: US 10,058,171 B2
(45) Date of Patent: Aug. 28, 2018

(54) FOLDING SHELF

(71) Applicant: Shaomao Deng, Huizhou (CN)

(72) Inventor: Shaomao Deng, Huizhou (CN)

(73) Assignee: IP Power Holdings Limited, Hong Kong (CN)

( * ) Notice: Subject to any disclaimer, the term of this patent is extended or adjusted under 35 U.S.C. 154(b) by 0 days.

(21) Appl. No.: 15/445,807

(22) Filed: Feb. 28, 2017

(65) Prior Publication Data

US 2017/0245635 A1 Aug. 31, 2017

(30) Foreign Application Priority Data

Feb. 29, 2016 (CN) ..... 2016 2 0156108 U

(51) Int. Cl.

| | |
|---|---|
| ***A47B 43/00*** | (2006.01) |
| ***A47B 96/02*** | (2006.01) |
| ***A47B 87/00*** | (2006.01) |
| ***A47B 87/02*** | (2006.01) |

(52) U.S. Cl.

CPC ..... *A47B 43/00* (2013.01); *A47B 87/007* (2013.01); *A47B 87/0207* (2013.01); *A47B 96/021* (2013.01)

(58) Field of Classification Search

CPC ... A47B 43/00; A47B 87/007; A47B 87/0207; A47B 96/021; A47B 31/04; A47B 46/005; A47F 5/10; A47F 5/13

USPC ..... 211/188, 186, 149, 150; 108/162, 163, 108/166, 167

See application file for complete search history.

(56) References Cited

U.S. PATENT DOCUMENTS

| | | | | | |
|---|---|---|---|---|---|
| 604,875 | A * | 5/1898 | Canedy | A47F 7/08 | 211/149 |
| 903,821 | A * | 11/1908 | Karges | A47B 37/00 | 108/31 |
| 1,167,550 | A * | 1/1916 | Forsyth | A47F 5/13 | 108/163 |
| 1,198,431 | A * | 9/1916 | Forsyth | A47F 5/13 | 108/163 |
| 1,304,847 | A * | 5/1919 | Blais et al. | A47F 5/13 | 108/163 |
| 2,584,489 | A * | 2/1952 | Morrison | A47F 5/108 | 211/130.1 |
| 2,860,383 | A * | 11/1958 | Heisler | A63J 1/00 | 108/167 |

(Continued)

*Primary Examiner* — Patrick D Hawn

(74) *Attorney, Agent, or Firm* — Che-Yang Chen; Law Offices of Scott Warmuth

(57) ABSTRACT

A folding shelf may include a first shelving unit having first side frames, one or more shelving boards, a first retractable control unit; and a second shelving unit having second side frames, one or more second shelving boards, a second retractable control unit. The first/second retractable control unit may include a first/second main body; a first/second pole partially received in the first main body; and a first/second locking member. When the folding shelf is folded, the user can first twist a first/second locking element to untightened first/second main body and first/second pole. The user can then lift the side frames in the center portion as to collapse the shelf. More specifically, the sliding movement of the first pole and the second pole can bring two side frames toward the center portion of the folding shelf to significantly minimize the size thereof.

8 Claims, 7 Drawing Sheets

(56) References Cited

U.S. PATENT DOCUMENTS 3,093,247 A * 6/1963 Erickson ..... A47B 31/04 108/188
3,184,075 A * 5/1965 Cohen ..... A47F 5/01 108/91
4,155,311 A * 5/1979 Jackovin ..... A47B 87/0207 108/190
4,157,089 A * 6/1979 Loughrey ..... A61G 13/105 108/116
4,740,010 A * 4/1988 Moskovitz ..... A47B 31/04 108/170
5,131,547 A * 7/1992 Goldberg ..... A47F 5/13 108/166
5,806,864 A * 9/1998 Zielinski ..... B62B 3/02 280/42
6,073,894 A * 6/2000 Chen ..... A47J 37/0786 108/115
6,123,207 A * 9/2000 Mast ..... A47B 43/00 211/149
6,443,481 B1 * 9/2002 Stravitz ..... A47B 31/04 211/201
6,626,119 B2 * 9/2003 Wilton ..... A47F 3/004 108/118
6,663,203 B1 * 12/2003 Miller, Jr. ..... A47B 21/00 312/258
6,851,564 B2 * 2/2005 Ng ..... A47B 43/00 108/171
7,080,640 B2 * 7/2006 Sanders ..... A47J 33/00 126/30
7,389,887 B2 * 6/2008 Liang ..... A47B 43/00 211/149
7,637,220 B2 * 12/2009 Fu ..... A47B 43/00 108/115
8,256,629 B2 * 9/2012 Zhu ..... A47B 31/04 211/149
8,256,630 B2 * 9/2012 Zhu ..... A47B 31/04 211/149
8,468,956 B2 * 6/2013 Parizek ..... A47B 3/12 108/157.16
8,672,147 B2 * 3/2014 Lam ..... A47G 25/0685 211/149
9,060,601 B2 * 6/2015 Landry ..... A47B 43/00
9,226,574 B1 * 1/2016 Chen ..... A47B 43/00
9,474,368 B2 * 10/2016 Frankel ..... A47B 43/00
2002/0109441 A1 * 8/2002 Wang ..... A47B 43/00 312/258
2004/0238469 A1 * 12/2004 Ng ..... A47B 43/00 211/149
2006/0226101 A1 * 10/2006 Liang ..... A47B 43/00 211/149
2010/0326938 A1 * 12/2010 Zhu ..... A47B 31/04 211/149
2011/0068072 A1 * 3/2011 Zhu ..... A47B 31/04 211/149
2011/0203490 A1 * 8/2011 Carter ..... B25H 1/02 108/26
2014/0353271 A1 * 12/2014 Kruse ..... A47F 5/01 211/188
2015/0366338 A1 * 12/2015 Conod ..... A47B 43/00 108/48
2016/0066687 A1 * 3/2016 Frankel ..... A47B 43/00 211/149
2016/0095430 A1 * 4/2016 Moyer ..... A47B 47/0091 312/265.4
2017/0245635 A1 * 8/2017 Deng ..... A47B 43/00

* cited by examiner

FOLDING SHELF

FIELD OF THE INVENTION

The present invention is directed to a shelf, and in particular to a folding shelf, the configuration of which can be easily change according to the preference of the user.

BACKGROUND OF THE INVENTION

A conventional shelf may include a plurality of tubes, rods, screws and connectors with different sizes. For easy storage and transportation, these components of the shelf are separately packaged and the user may have to spend quite a long time to assemble the shelf. Also, it is inconvenient for the wholesalers to assemble the shelf and deliver to the customer's place.

Furthermore, even though the user can successfully assemble the shelf, it may be impossible for the user to store the shelf when not in use because the conventional shelf usually cannot be folded to minimize its size. Therefore, there remains a need for a new and improved folding shelf that is more convenient and efficient for the user to store or transport to overcome the problems presented above.

SUMMARY OF THE INVENTION

In one aspect, a folding shelf may include a first shelving unit having first side frames, one or more shelving boards, a first retractable control unit; and a second shelving unit having second side frames, one or more second shelving boards, a second retractable control unit. In one embodiment, both sides of the first shelving board can be pivotally connected to predetermined portions of the first side frames and both sides of the second shelving board can be pivotally connected to predetermined portions of the second side frames. In another embodiment, each of the first shelving unit and second shelving unit has two side frames respectively on both sides thereof, and the a first top portion of one side of the first side frames is pivotally connected with a second top portion of adjacent second side frame through a connecting unit.

More specifically, the first shelving unit and the second shelving unit are disposed side by side, and the first side frames and the second side frames are disposed in a parallel manner. In one embodiment, each of the first shelving unit and the second shelving unit may have two first and second shelving boards respectively. The first shelving boards are pivotally connected with two first side frames, as well as the second shelving boards pivotally connecting with two side frames. In another embodiment, a plurality of supporting units are disposed at a bottom portion of each first shelving unit and the second shelving unit to increase the stability thereof. In a further embodiment, the first shelving board disposed on a top portion of the first side frame is substantially aligned with the second shelving board disposed on a top portion of the second side frame, while the first shelving board disposed on a bottom portion of the first side frame is substantially aligned with the second shelving board disposed on a bottom portion of the second side frame. It is noted that the shelving boards can be made by wood. In one embodiment, the surface of the shelving board can be meshed.

In a further embodiment, a first hole is disposed on the top portion of one side of the side frames and a second hole is disposed on the top portion of a corresponding side frame. The first shelving unit can be flipped for ninety degrees on top of the second shelving unit. Meanwhile, the first hole and the second hole are configured to be aligned and a locking unit is configured to insert into both the first and second through holes to lock the entire structure of the folding shelf. In one embodiment, the locking unit can be a screw and the second hole is a screw hole. In another embodiment, the second hole can be a through hole and the locking unit can be a combination of a screw and a nut. In a further embodiment, there can be no holes and locking unit and the two shelving units can be secured with a Velcro.

The first retractable control unit may include a first main body; a first pole partially received in the first main body; and a first locking member. In one embodiment, the first main body is pivotally connected with the one side of the first side frames and the first pole is pivotally connected with the other side of the first side frames. For example, one end of the first retractable control unit is pivotally connected with a lower portion of one first side frame and the other end thereof is pivotally connected with the other first side frame slightly below the top shelving board. The first locking member is configured to lock the first main body and the first pole. Likewise, the second retractable control unit may include a second main body; a second pole partially received in the second main body; and a second locking member. In one embodiment, the second main body is pivotally connected with the one side of the second side frames and the second pole is pivotally connected with the other side of the second side frames. The second locking member is configured to lock the second main body and the second pole.

In one embodiment, the cross section of the first main body and the first pole is rectangular, as well as the cross section of the second main body and the second pole. The first locking element can be a screw that can be manually operated, which is configured to tighten a portion of the first pole that is inserted into the first main body. Similarly, the second locking element can be a screw that can be manually operated, which is configured to tighten a portion of the second pole that is inserted into the second main body. It is noted that the cross section area of the first (second) pole is smaller than that of the first (second) main body.

When the folding shelf is folded, the user can first twist the first locking element so the first main body and first pole can be untightened. Namely, the first main body and the first pole are slidably connected with each other at the present stage. Likely, the second locking element can be untightened so the second main body and the second pole are slidably connected with each other. The user can then lift the side frames in the center portion to collapse the shelf. More specifically, the sliding movement of the first pole and the second pole can bring two side frames toward the center portion of the folding shelf to significantly minimize the size thereof.

As discussed above, the configuration of the folding shelf can be changed by flipping one shelving unit on top of the other one. For example, the first shelving unit can be flipped for degrees to be on top of the second shelving unit, and the locking unit is configured to insert the first hole and second hole to lock the first shelving unit and second shelving unit.

Comparing with conventional shelves, the folding shelf in the present invention is advantageous because it can be easily folded through two retractable control units, so it can be compactly stored and shipped. Furthermore, the configuration of the folding shelf can be changed by simply flipping one shelving unit on top of the other to provide the user more choices according to the user's preference or the space at home.

DETAILED DESCRIPTION OF THE INVENTION

Figure 1:
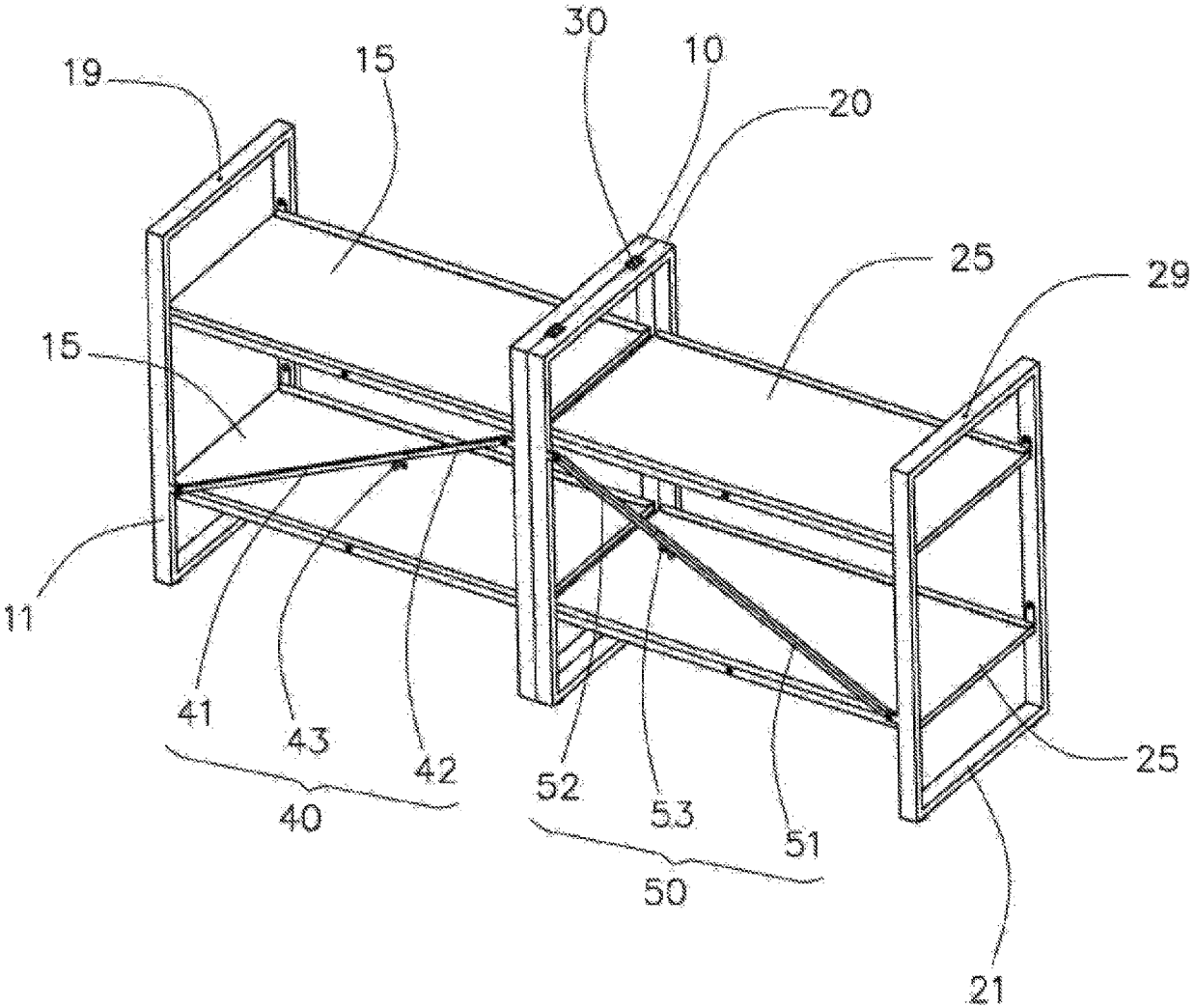
FIG. 1 illustrates a perspective view of the folding shelf in the present invention.
Figure 2:
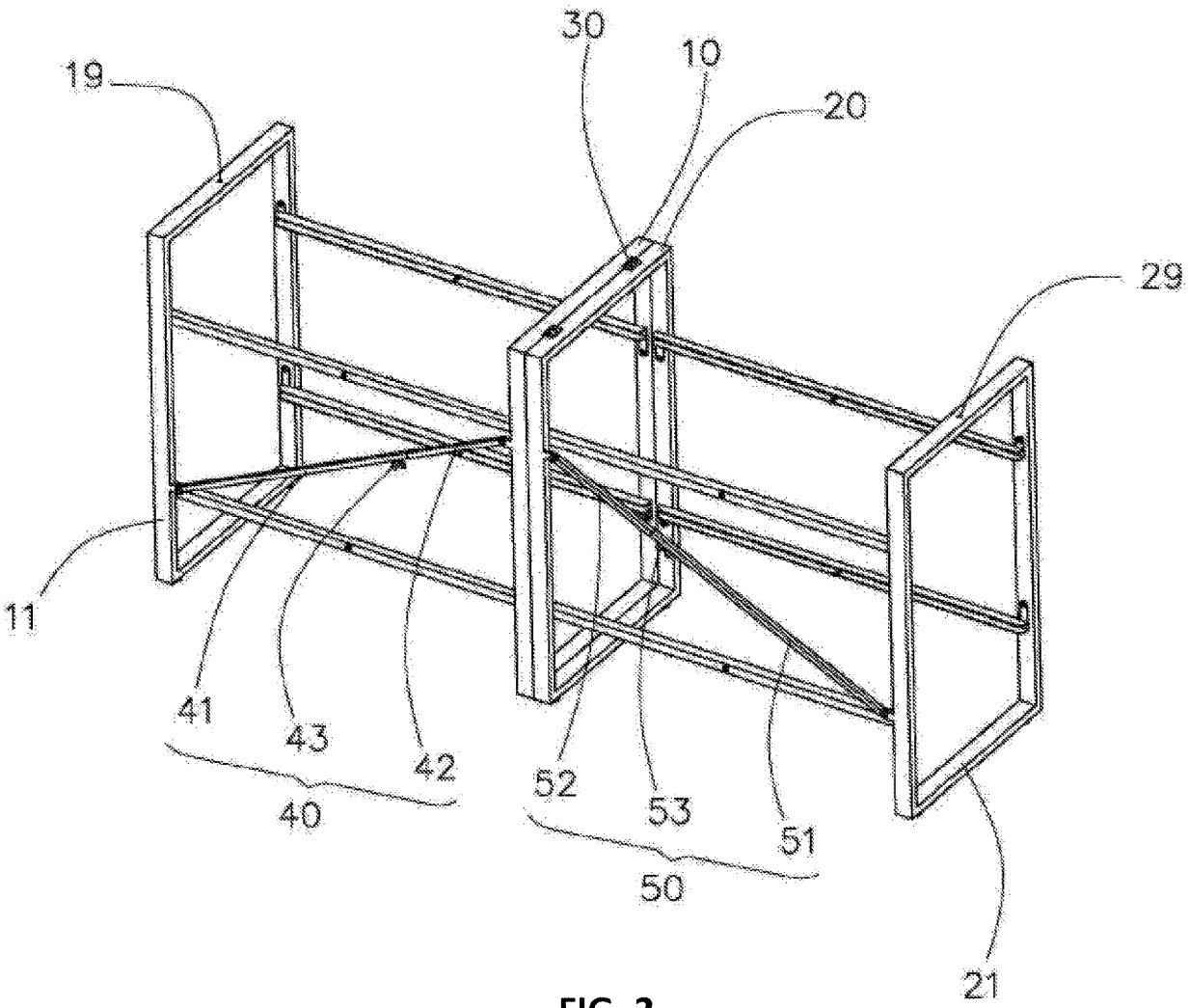
FIG. 2 illustrates a perspective view of the folding shelf in the present invention without the shelving boards.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

In order to further understand the goal, characteristics and effect of the present invention, a number of embodiments along with the drawings are illustrated as following:

In one aspect, referring to FIGS. 1 to 7, a folding shelf may include a first shelving unit 10 having first side frames 11, one or more shelving boards 15, a first retractable control unit 40; and a second shelving unit 20 having second side frames 21, one or more second shelving boards 25, a second retractable control unit 50. In one embodiment, both sides of the first shelving board 15 can be pivotally connected to predetermined portions of the first side frames 11 and both sides of the second shelving board 25 can be pivotally connected to predetermined portions of the second side frames 21. In another embodiment, each of the first shelving unit 10 and second shelving unit 20 has two side frames 11 and 21 respectively on both sides thereof, and a first top portion of one side of the first side frames 11 is pivotally connected with a second top portion of adjacent second side frame 21 through a connecting unit 30.

Figure 4:
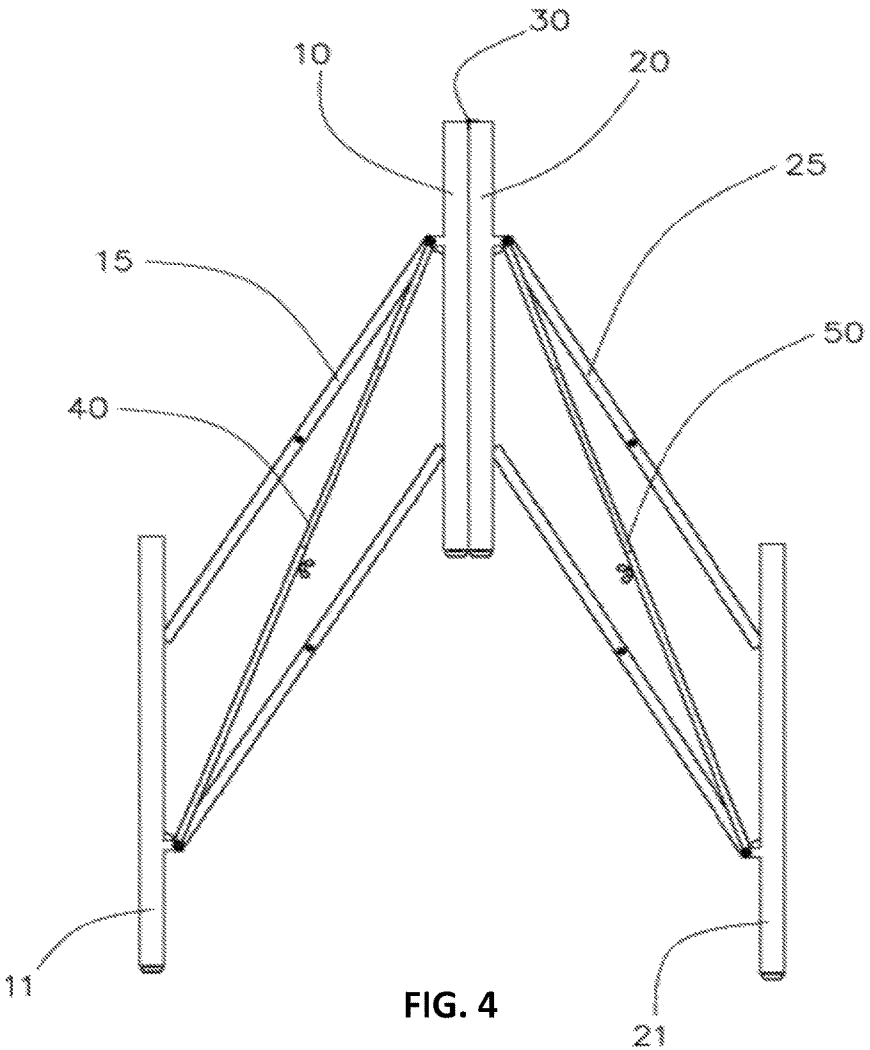
FIG. 4 illustrates a front view of the folding shelf in the present invention when the folding shelf is partially folded.
Figure 5:
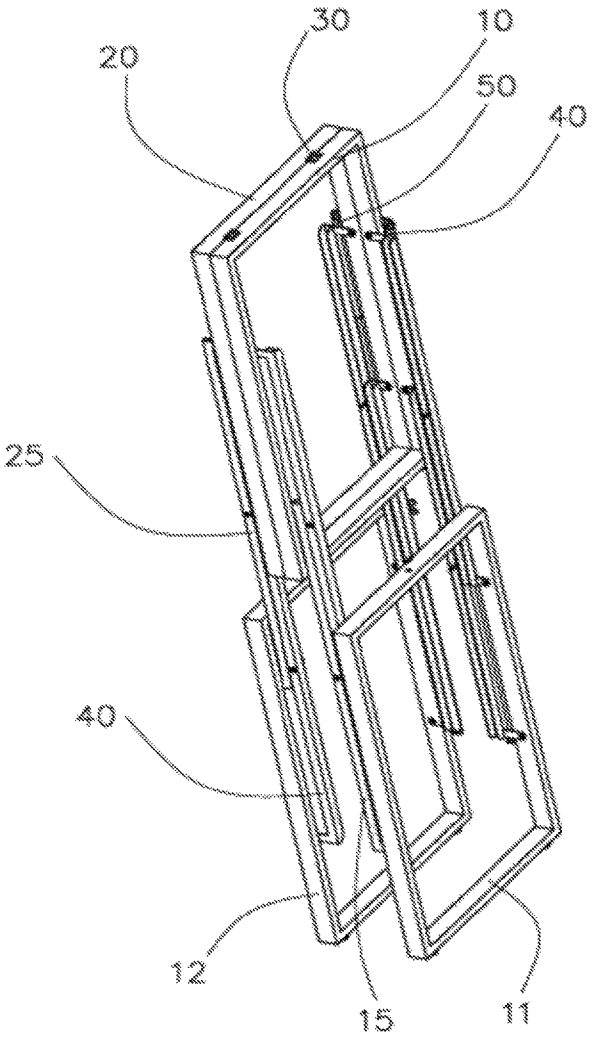
FIG. 5 illustrates a perspective view of the folding shelf in the present invention when the folding shelf is completely folded.
Figure 6:
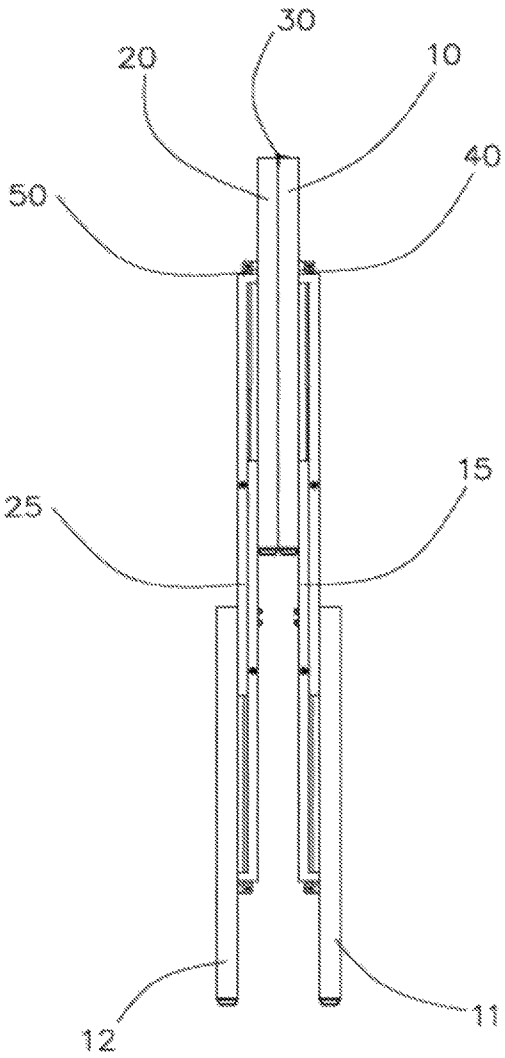
FIG. 6 illustrates a front view of the folding shelf in the present invention when the folding shelf is completely folded.

More specifically, the first shelving unit 10 and the second shelving unit 20 are disposed side by side, and the first side frames 11 and the second side frames 21 are disposed in a parallel manner. In one embodiment, each of the first shelving unit 10 and the second shelving unit 20 may have two first and second shelving boards 15 and 25 respectively. The first shelving boards 15 are pivotally connected with two first side frames 11 as shown in FIG. 4, as well as the second shelving boards 25 pivotally connecting with two side frames 21. In another embodiment, a plurality of supporting units are disposed at a bottom portion of each first shelving unit 10 and the second shelving unit 20 to increase the stability thereof. In a further embodiment, the first shelving board 15 disposed on a top portion of the first side frame 11 is substantially aligned with the second shelving board 25 disposed on a top portion of the second side frame 21, while the first shelving board 15 disposed on a bottom portion of the first side frame 11 is substantially aligned with the second shelving board 25 disposed on a bottom portion of the second side frame 21. It is noted that the shelving boards can be made by wood. In one embodiment, the surface of the shelving board can be meshed.

Figure 7:
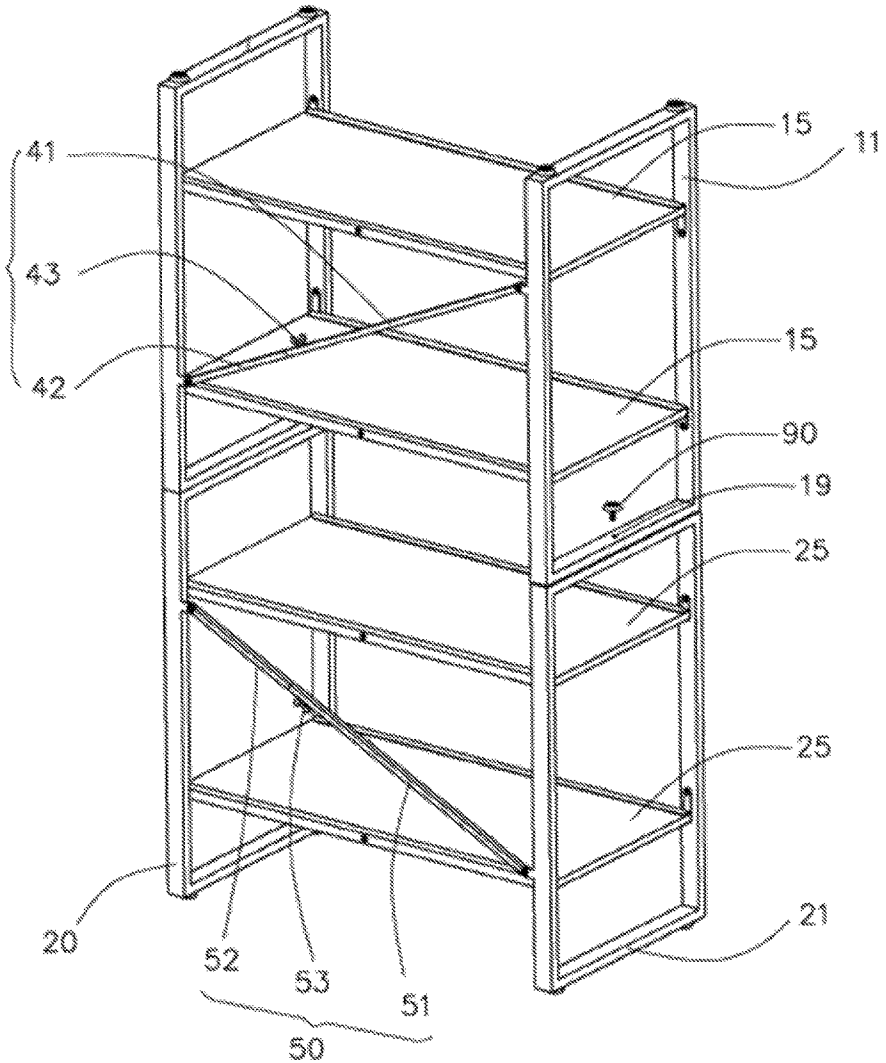
FIG. 7 illustrates a perspective view of the folding shelf in the present invention when the first shelving unit is flipped on top of the second shelving unit.

In a further embodiment, a first hole 19 is disposed on the top portion of one side of the side frames 11 and a second hole 29 is disposed on the top portion of a corresponding side frame 21. As shown in FIG. 7, the first shelving unit 10 can be flipped for ninety degrees on top of the second shelving unit 20. Meanwhile, the first hole 19 and the second hole 29 are configured to be aligned and a locking unit 90 is configured to insert into both the first and second holes to lock the entire structure of the folding shelf. In one embodiment, the locking unit 90 can be a screw and the second hole 29 is a screw hole. In another embodiment, the second hole 29 can be a through hole and the locking unit 90 can be a combination of a screw and a nut. In a further embodiment, there can be no holes and locking unit and the two shelving units can be secured with a Velcro.

The first retractable control unit 40 may include a first main body 41; a first pole 42 partially received in the first main body 41; and a first locking member 43. In one embodiment, the first main body 41 is pivotally connected with the one side of the first side frames 11 and the first pole 42 is pivotally connected with the other side of the first side frames 11. For example, one end of the first retractable control unit 40 is pivotally connected with a lower portion of one first side frame 11 and the other end thereof is pivotally connected with the other first side frame 11 slightly below the top shelving board. The first locking member 43 is configured to lock the first main body 41 and the first pole 42. Likewise, the second retractable control unit 50 may include a second main body 51; a second pole 52 partially received in the second main body 51; and a second locking member 53. In one embodiment, the second main body 51 is pivotally connected with the one side of the second side frames 11 and the second pole 52 is pivotally connected with the other side of the second side frames 11. The second locking member 53 is configured to lock the second main body 51 and the second pole 52.

In one embodiment, the cross section of the first main body 41 and the first pole 42 is rectangular, as well as the cross section of the second main body 51 and the second pole 52. The first locking element 43 can be a screw that can be manually operated, which is configured to tighten a portion of the first pole 42 that is inserted into the first main body 41. Similarly, the second locking element 53 can be a screw that can be manually operated, which is configured to tighten a portion of the second pole 52 that is inserted into the second main body 51. It is noted that the cross section area of the first (second) pole 42 (52) is smaller than that of the first (second) main body 41 (51).

Figure 3:
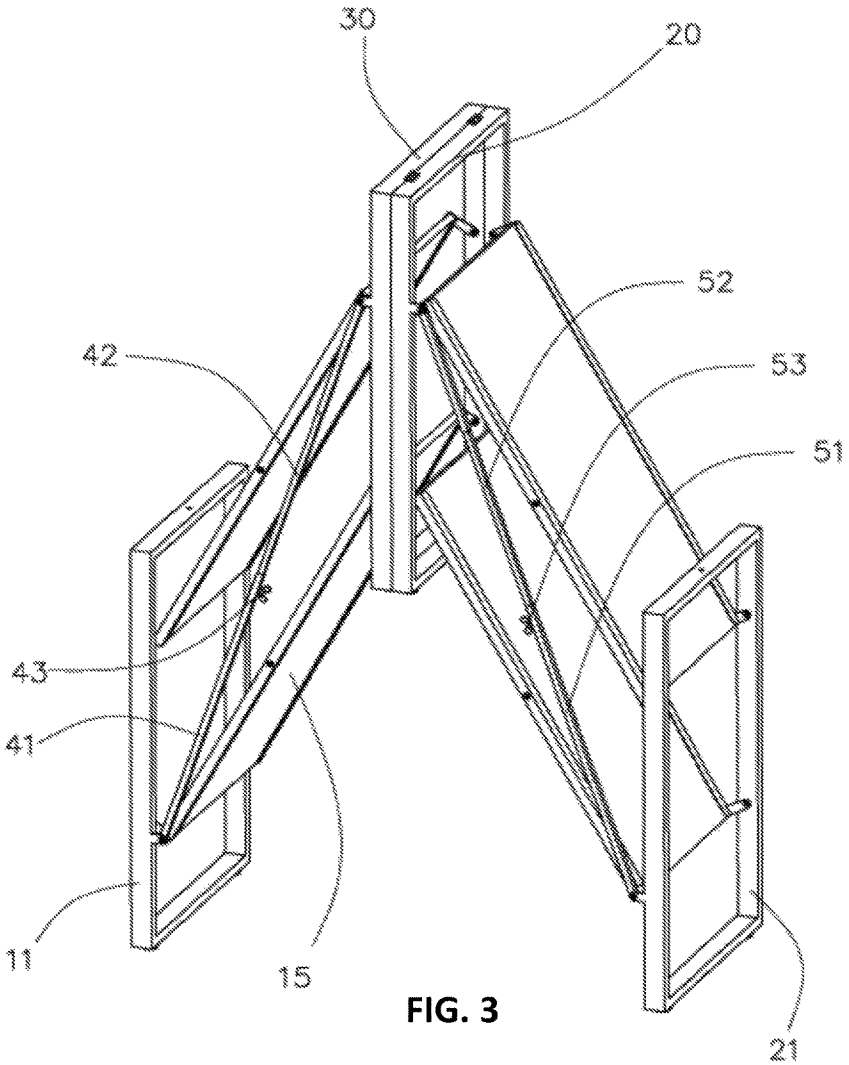
FIG. 3 illustrates a schematic view of the folding shelf in the present invention when the folding shelf is partially folded.

Referring to FIGS. 3 to 6, when the folding shelf is folded, the user can first twist the first locking element 43 so the first main body 41 and first pole 42 can be untightened. Namely, the first main body 41 and the first pole 42 are slidably connected with each other at the present stage. Likely, the second locking element 53 can be untightened so the second main body 51 and the second pole 52 are slidably connected with each other. The user can then lift the side frames 11 and 12 in the center portion as shown in FIG. 3 to collapse the shelf. More specifically, the sliding movement of the first pole 42 and the second pole 52 can bring two side frames 11 and 12 toward the center portion of the folding shelf to significantly minimize the size thereof.

As discussed above, the configuration of the folding shelf can be changed by flipping one shelving unit on top of the other one. For example, the first shelving unit 10 can be flipped for 90 degrees to be on top of the second shelving unit 20, and the locking unit 90 is configured to insert the first hole 19 and second hole 29 to lock the first shelving unit 10 and second shelving unit 20.

Comparing with conventional shelves, the folding shelf in the present invention is advantageous because it can be easily folded through two retractable control units 40 and 50, so it can be compactly stored and shipped. Furthermore, the configuration of the folding shelf can be changed by simply flipping one shelving unit on top of the other to provide the user more choices according to the user's preference or the space at home.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A folding shelf comprising a first shelving unit having first side frames and a first retractable control unit; and a second shelving unit having second side frames and a second retractable control unit; the first retractable control unit having a first main body, and a first pole partially received in the first main body to slidably move therein; the second retractable control unit having a second main body, and a second pole partially received in the second main body to slidably move therein, wherein a first hole is disposed on the top portion of one of the first side frames near outside of the folding shelf, and a second hole is disposed on the top portion of one of the second side frames near outside of the folding shelf, wherein the first shelving unit is configured to flip for ninety degrees on top of the second shelving unit, and the first hole and the second hole are substantially aligned, and a locking unit is configured to insert into both the first and second holes to lock the folding shelf, and wherein when the folding shelf is folded, one of the first and second side frames near a center portion of the folding shelf is lifted to cause sliding movement of the first pole and the second pole in the first main body and second main body respectively to bring two side frames toward the center portion of the folding shelf to minimize the size thereof.

2. The folding shelf of claim 1, wherein first shelving unit has one or more first shelving boards, and the second shelving unit has one or more second shelving boards, and both sides of the first shelving board are pivotally connected to predetermined portions of the first side frames and both sides of the second shelving board are pivotally connected to predetermined portions of the second side frames.

3. The folding shelf of claim 1, wherein a first top portion of one side of the first side frames is pivotally connected with a second top portion of adjacent second side frame through a connecting unit.

4. The folding shelf of claim 1, wherein the first shelving unit and the second shelving unit are disposed side by side, and the first side frames and the second side frames are disposed in a parallel manner.

5. The folding shelf of claim 1, wherein each of the first and second retractable control units has a first locking and a second locking element respectively to tighten a portion of each of the first and second poles respectively that is inserted into the first and second main body.

6. The folding shelf of claim 1, wherein each of the first and second main body is pivotally connected with one side of the first and second side frames, and each of the first and second poles is pivotally connected with the other side of the first and second side frames.

7. The folding shelf of claim 1, wherein a surface of each of the first and second shelving board is meshed.

8. The folding shelf of claim 1, wherein a cross section of the first and second main body and the first and second pole is rectangular.

* * * * *